US010094070B2

(12) United States Patent
Buda

(10) Patent No.: US 10,094,070 B2
(45) Date of Patent: Oct. 9, 2018

(54) RAIL FASTENING SYSTEM

(71) Applicant: SCHWIHAG AG, Taegerwilen (CH)

(72) Inventor: Roland Buda, Radolfzell am Bodensee (DE)

(73) Assignee: SCHWIHAG AG, Taegerwilen (CH)

( * ) Notice: Subject to any disclaimer, the term of this patent is extended or adjusted under 35 U.S.C. 154(b) by 238 days.

(21) Appl. No.: 14/900,880

(22) PCT Filed: Sep. 3, 2014

(86) PCT No.: PCT/EP2014/068752
§ 371 (c)(1),
(2) Date: Dec. 22, 2015

(87) PCT Pub. No.: WO2015/036304
PCT Pub. Date: Mar. 19, 2015

(65) Prior Publication Data

US 2016/0138226 A1 May 19, 2016

(30) Foreign Application Priority Data

Sep. 13, 2013 (DE) ..... 10 2013 218 424

(51) Int. Cl.
*E01B 9/68* (2006.01)

(52) U.S. Cl.
CPC ..... *E01B 9/681* (2013.01)

(58) Field of Classification Search
CPC ..... E01B 9/681
See application file for complete search history.

(56) References Cited

U.S. PATENT DOCUMENTS

| | | | | |
|---|---|---|---|---|
| 4,771,944 | A * | 9/1988 | Brister | E01B 9/681 238/283 |
| 5,195,679 | A * | 3/1993 | Leeves | E01B 9/681 238/283 |
| 5,735,457 | A | 4/1998 | Boehm et al. | |
| 6,045,052 | A * | 4/2000 | Besenschek | E01B 9/681 238/264 |
| 6,342,287 | B1 * | 1/2002 | Kaczmarek | E01B 9/68 238/283 |
| 6,386,461 | B1 * | 5/2002 | Wildgoose | E01B 9/68 238/283 |
| 2006/0043205 | A1 * | 3/2006 | Nevins | E01B 9/681 238/283 |

(Continued)

FOREIGN PATENT DOCUMENTS

| | | |
|---|---|---|
| CN | 201962561 U | 9/2011 |
| CN | 202081347 U | 12/2011 |

(Continued)

*Primary Examiner* — Jason C Smith
(74) *Attorney, Agent, or Firm* — Andrew Wilford

(57) ABSTRACT

A rail-mounting assembly (S) for fastening a rail (3) to a fixed substrate (5) with an intermediate construction (2) between the rail (3) and the fixed substrate (5) that operatively connects the rail (3) to the fixed substrate (5) in an elastic manner, and the intermediate construction (2) comprises only a elastic intermediate layer element (1; 101) that has a variable elasticity distribution across its cross-section (6) in the direction (7A) of its longitudinal extension (8) and/or in the direction (7B) transverse to its longitudinal extension (8).

24 Claims, 8 Drawing Sheets

(56) References Cited

U.S. PATENT DOCUMENTS

| | | | | |
|---|---|---|---|---|
| 2009/0261177 | A1* | 10/2009 | Hamilton | E01B 3/28 238/283 |
| 2010/0127092 | A1* | 5/2010 | Seifert | E01B 9/28 238/265 |
| 2010/0206958 | A1* | 8/2010 | Cox | E01B 9/686 238/283 |
| 2014/0103132 | A1* | 4/2014 | Lienhard | E01B 9/303 238/283 |
| 2014/0371373 | A1* | 12/2014 | Harrass | B29C 45/46 524/494 |
| 2016/0138226 | A1* | 5/2016 | Buda | E01B 9/681 238/283 |
| 2016/0194835 | A1* | 7/2016 | Miessbacher | E01B 9/42 238/275 |
| 2017/0107672 | A1* | 4/2017 | Lombardini | E01B 9/681 |

FOREIGN PATENT DOCUMENTS

| | | | |
|---|---|---|---|
| CN | 202214663 | U | 5/2012 |
| EA | 014168 | B1 | 1/2006 |
| FR | 2086643 | A | 12/1971 |
| FR | 2899605 | A | 10/2007 |
| KZ | 662 | U | 4/2010 |
| RU | 09853 | U1 | 5/1999 |
| UA | 049744 | A | 9/2002 |
| WO | 2000071815 | A | 11/2000 |

* cited by examiner

RAIL FASTENING SYSTEM

CROSS REFERENCE TO RELATED APPLICATIONS

This application is the US-national stage of PCT application PCT/EP2014/068752 filed 3 Sep. 2014 and claiming the priority of German patent application 102013218424.7 itself filed 13 Sep. 2013.

FIELD OF THE INVENTION

The invention relates to a rail-mounting assembly for fastening a rail to a fixed substrate with an intermediate construction between the rail and the fixed substrate that operatively connects the rail to the fixed substrate in an elastic manner.

BACKGROUND OF THE INVENTION

Prototypical rail-mounting assemblies are already known from the prior art for fixing rails on a correspondingly designed subsurface. A subsurface suitably designed in this regard comprises, for example, a ballasted track or a fixed substrate. In order to ensure sufficiently good vibration characteristics, particularly in the use of a fixed substrate, the rail-mounting assembly used here must be designed in an elastic manner due to the rigid subsurface construction. These elastic characteristics may be ensured by means of an elastically designed intermediate structure in the form of a combination of elastic and highly elastic components that are between the rails and parts of the fixed substrate, such as a concrete sleeper, so that through the use of these elastic and highly elastic components, in particular in mainline axle loads (in Europe typically 22.5 t) or in high-speed traffic (up to 350 km/h), these demands can be met. The elastic and highly elastic components have, for example, on the one hand an elastic intermediate layer with a spring rate between 100 kN/mm and 500 kN/mm directly under a rail foot of the rail and on the other hand a highly elastic intermediate plate with a spring rate between 15 kN/mm and 40 kN/mm under a steel rib or steel load distribution plate. However, due to the large number of necessary components, these known rail-mounting assemblies have proven to be very costly to manufacture and assemble. In addition to the different elastic components, most prototypical rail-mounting assemblies still comprise rail fastening plates with angle guide plates thereon, as well as at least two first tension clamps for tensioning a rail foot of the rail with the rail fastening plate and, further, a plurality of screws for screwing the rail-mounting assembly to the parts of the fixed substrate or ballasted track.

OBJECT OF THE INVENTION

The object of the invention is to design prototypical rail-mounting assemblies for a fixed substrate in a structurally simpler manner while maintaining the required elasticity.

SUMMARY OF THE INVENTION

The object of the invention is achieved by a rail-mounting assembly for fastening a rail to a fixed substrate and an intermediate construction between the rail and the fixed substrate that operatively connects the rail to the fixed substrate in an elastic manner, where according to the invention the intermediate construction comprises only a elastic intermediate intermediate layer element that has a variable elasticity distribution across its cross-section in the direction of its longitudinal extension and/or in the direction transverse to its longitudinal extension.

Through the use of the single such inventively designed elastic intermediate intermediate layer element, a further highly elastic intermediate plate or the like can be dispensed with, and the construction of the rail-mounting assembly can be simplified significantly. This simplifies especially installation of the rail-mounting assembly, which, given the plurality of such rail-mounting assemblies used along a railroad line, has an enormous savings potential for materials and installation time.

Of particular note here is the embodiment of a variable elasticity distribution both in the direction of the longitudinal extension of the intermediate layer element and in the direction of the transverse extension of the intermediate layer element, of which in particular the variable elasticity distribution in the transverse extension has an especially positive effect on the elasticity behavior of the rail-mounting assembly.

Thus in the present case it is possible to structurally achieve the total elasticity required with respect to the fixed substrate only through the intermediate layer element of the rail-mounting assembly according to the invention.

The term "fixed substrate" describes not only that of the context of the invention, but also in the technical literature a substantially ballast-free substrate, where in particular concrete sleepers to which the rail-mounting assemblies are fastened do not lie on ballast, but rather are mostly solidly fixed on a rigid structure embedded in the ground. Alternatively, the rail-mounting assemblies of this type are fastened directly onto prefabricated concrete plates without sleepers. Due to such a rigid underground structure or concrete structure, such rail-mounting assemblies must be elastically designed.

To this extent, the invention relates to a fixed substrate rail-mounting assembly.

Preferably, the intermediate layer element is directly adjacent a lower face of the rail, so that the rail is directly mounted in an elastically well-sprung manner.

Particularly good elastic properties can be achieved if the intermediate layer element has an elastically deformable inner region that is peripherally spaced from the edges of the intermediate layer element.

In this context it is of particular advantage if the elastically deformable inner region has a minimum spacing from all edges of the intermediate layer element of 20 mm in order to ensure good stability of the intermediate layer element as a whole.

In this respect, according to an advantageous embodiment also the spacing of the elastically deformable inner region from the edges of the intermediate layer element is smaller than 30 mm, preferably smaller than 20 mm.

It is further advantageous if a less elastically deformable outer region completely surrounds the elastically deformable inner region. This less elastically deformable outer region can be contiguously formed, so as to achieve very good stability of the intermediate layer element.

It is understood that the elastically deformable inner region can be designed in many ways.

If the intermediate layer element has an elastically deformable inner region that is concentrically around a center point, an advantageous elasticity distribution can be achieved in the intermediate layer element.

In the full area of its circumferential edge region, the intermediate layer element may experience an advantageously increased rigidity if the intermediate layer element has a circular, elliptical or oval elastic inner region that is more elastically deformable than a less elastically deformable outer region adjacent the circular, elliptical or oval elastic inner region.

A very good elasticity distribution can be achieved in the single elastically designed intermediate layer element if the elastically deformable inner region has a diameter between 60 mm and 100 mm, preferably 80 mm.

It is understood that the elastically differently designed regions of the intermediate layer element can be created in a structurally different manner, for example by adjacent material regions with different elastic properties.

A preferred embodiment provides that the elastically deformable inner region is thinner than an adjacent less elastically deformable outer region of the intermediate layer element. The here desired elasticity distribution can be achieved in a structurally simple manner in particular by a correspondingly designed central material weakening of the intermediate layer element.

For example, the intermediate layer element has a preferably central recess dimensioned such that the edge region of the intermediate layer element has a lower elasticity and thus higher inherent rigidity than the elastically deformable inner region. In this way, rail rolling and rail tilting caused by transverse forces acting on the rail are significantly reduced.

This recess is preferably either circular, elliptical or oval.

The elastically deformable inner region preferably has a thickness between 3 mm and 10 mm, preferably a thickness of 5.5 mm, in order to achieve the desired elasticity distribution.

The elasticity distribution that is variable across the cross-section of the intermediate layer element may in particular be advantageously realized if the elastically deformable inner region has a diameter-thickness ratio of 15:1.

The elastically deformable inner region preferably has a diameter of 80 mm with a thickness of 5.5 mm, equal to a diameter-thickness ratio of 14.55 that in the context of the invention corresponds approximately to a diameter-thickness ratio of 15:1.

The elastic intermediate layer element of the present rail-mounting assembly may also in particular be integrated into existing rail-mounting assemblies if the intermediate layer element has external dimensions with a ratio of width: depth:height of 21:15:1, preferably 210 mm×148 mm×10 mm.

Insofar as the external dimensions of the intermediate layer element are preferably 210 mm×148 mm×10 mm, this means that the external dimensions have the ratio of 21:15:1, and the diameter of the elastically deformable inner region is preferably 80 mm at a thickness of the elastically deformable inner region of 5.5 mm.

Furthermore, it is advantageous if the intermediate layer element has a supporting ratio of 1.2 with respect to a total coverage surface of the rail to the actual load-bearing support surface of the intermediate layer element.

Preferably, the total coverage surface of the intermediate layer element that is covered by the rail is 31.080 $mm^2$, with an effective support surface, and the intermediate layer element remains in permanent operative contact with the rail, of 26.053 $mm^2$.

It is further advantageous if the intermediate layer element has a static spring rate of 35 kN/mm (±15%), and this static spring rate is measured as a secant between 28 kN and 78 kN.

In addition, it is advantageous if the intermediate layer element has a dynamic spring rate of <45 kN/mm (±15%), and at room temperature (21°) and at a frequency of 15 Hz, this dynamic spring rate is measured as a secant between 28 kN and 78 kN.

In this context, it is also advantageous if the intermediate layer element has a relationship between dynamic spring rate and static spring rate with a stiffening factor of <1.3.

It is understood that the intermediate layer element can be manufactured from different materials in order to fulfill the necessary properties, in particular within the context of the invention. For example, foamed plastics or the like may generally come into consideration here. It has been shown that in particular terpolymer elastomers, such as in particular ethylene propylene diene rubber, EPDM for short, foamed, closed-cell polyurethane (PU) or the like can meet the present requirements particularly well over the long term.

To this extent, it is advantageous if the intermediate layer element has a body made of microcellular rubber or polyurethane.

Further lightening of the intermediate layer element can easily be achieved if the intermediate layer element has an elongated notch on each of at least two of its edges.

The elongated notch preferably extends in the direction of the long sides of the intermediate layer element, and the elongated notches may be notched out more greatly from the intermediate layer element.

Furthermore, an advantageous interlocking of the intermediate layer element with one or more angle guide plates of the rail-mounting assembly can be achieved if the intermediate layer element has a projecting tooth on each of at least two of its edges. These projecting teeth project past the notch so that they can interlock well with a complementarily formed angle guide plate.

According to another aspect, the invention has the further object of providing a simplified rail-mounting assembly for a polyvalent fixed substrate, meaning that the present rail-mounting assembly is also designed for use with fixed substrates in which any concrete sleepers or the like allow two different track widths, and these sleepers or the like are embedded in a correspondingly rigid underground structure.

This further object of the invention is achieved by a development of the rail-mounting assembly in which the fixed substrate comprises polyvalent sleepers, and the intermediate construction of the rail-mounting assembly comprises a hard trapezoidal intermediate layer element, having a trapezoidal part that is between the intermediate layer element and a part of the fixed substrate.

In addition to the intermediate layer element as has already been described above in detail, the intermediate construction preferably also has a hard trapezoidal intermediate layer element, so that polyvalent sleepers may also be used on a fixed substrate by means of the present rail-mounting assembly.

Although the present trapezoidal intermediate layer element may also have a certain inherent elasticity, this is negligibly small in the context of the invention and specifically in relation to the intermediate layer element, so that the trapezoidal intermediate layer element is designed to be significantly harder than the single intermediate layer element. In this respect, the intermediate construction also still has a total of only one intermediate layer element.

In order to conduct transverse forces exerted on the rails into the fixed substrate, the rail-mounting assembly further comprises angle guide plates with trapezoidally formed raised parts that can engage in complementarily formed trapezoidal grooves of the sleepers or the like, so that transverse forces arising during operation can be conducted into the fixed substrate.

Due to the two required track widths that necessitate two different installation positions of the rail-mounting assembly, it is necessary with a polyvalent sleeper that four trapezoidal grooves are present on each side of the sleeper.

However, this also means that during installation of a rail-mounting assembly, one of the trapezoidal grooves is covered.

In this respect, it is necessary that this trapezoidal groove is filled with a filler element, so that the intermediate layer element positioned under the rail foot can be fully supported on the sleeper.

According to the prior art, in a polyvalent sleeper that nevertheless is only suitable for a classic ballasted track and not for a fixed substrate, as the previously used rail-mounting assemblies do not achieve the required elasticity, a trapezoidal wedge is installed as a filler element for the covered trapezoidal groove, in order to ensure that the rail foot can be fully supported on the polyvalent sleeper. A disadvantage here, however, is that the trapezoidal wedge cannot be fixed.

In this respect, it is advantageous if the rail-mounting assembly comprises a hard trapezoidal intermediate layer element, having a trapezoidal part that is between the intermediate layer element and a part of the fixed substrate.

The construction of the present rail-mounting assembly can be further simplified if the hard trapezoidal intermediate layer element is fixed on the fixed substrate by means of lateral angle guide plates. In this way, the trapezoidal part of the hard trapezoidal intermediate layer element acting as a filler element may be simply structurally clamped and thus fixed in place on the polyvalent sleeper with a known angle guide plate. As a result, further fastening means are superfluous.

The present rail-mounting assembly, or the hard trapezoidal intermediate layer element having a trapezoidal part, may also be used without problems on commercial polyvalent sleepers if the trapezoidal part of the hard trapezoidal intermediate layer element is associated with the fixed substrate.

Advantageously, the trapezoidal part of the hard trapezoidal intermediate layer element can be fixed in the corresponding trapezoidal groove by the rail.

It is thus useful if the trapezoidal part is below the rail.

The trapezoidal element may be provided in a particularly stable manner on the hard trapezoidal intermediate layer element if the trapezoidal part has a trapezoidal body reinforced by cross ribs.

Cumulatively or alternatively, it is advantageous if the trapezoidal part is tubular. In this way, the trapezoidal part may better conform to the shape of the trapezoidal groove, and active contact between the trapezoidal intermediate layer element and the polyvalent sleeper can be intensified. Further, the hard trapezoidal intermediate layer element can be produced with a smaller amount of material.

If the tubular body has a two-part cavity that is spatially divided by a transverse inner web, the tubular part of trapezoidal section has improved stability.

A further material saving may be achieved in the hard trapezoidal intermediate layer element if the hard trapezoidal intermediate layer element has an elongated notch on each of at least two of its edges.

The elongated notches preferably extend in the direction of the long sides of the hard trapezoidal intermediate layer element, and the elongated notches may be recessed more greatly from the intermediate layer element.

An advantageous interlocking of the hard trapezoidal intermediate layer element with one or more angle guide plates of the rail-mounting assembly can be achieved if the intermediate layer element has a projecting tooth on each of at least two of its edges. These projecting teeth project past the notches such that they can interlock exceedingly well with a complementarily formed angle guide plate.

It should again be expressly understood here that prototypical rail-mounting assemblies can be advantageously further developed solely through the features related to the hard trapezoidal intermediate layer element, so that this feature combination is advantageous even without the other features of the invention.

In particular, a rail-mounting assembly equipped with the present trapezoidal intermediate layer element fulfills the requirements for use on a fixed substrate in combination with polyvalent sleepers.

According to an additional aspect of the invention, it is also advantageous independent of the other features of the invention if the rail-mounting assembly comprises an angle guide plate that has two recesses on each of at least two plate ends.

In this respect, a particular design for angle guide plates is proposed in a further independent embodiment variant of the rail-mounting assembly.

Here, the two recesses are formed in the angle guide plate such that both the two projecting teeth of the intermediate layer element and the two projecting teeth of the hard trapezoidal intermediate layer element can engage in the angle guide plate, and a particularly close operative connection can be created between the intermediate layer element and the angle guide plate on the one hand and the hard trapezoidal intermediate layer element and the angle guide plate on the other hand. In this way, the individual components of the rail-mounting assembly can interlock particularly well with one another.

In this respect, the angle guide plates themselves can transmit greater transverse forces acting on the rails into the fixed substrate or into the sleepers.

The two recesses are preferably of rectangular shape in an edge region of the angle guide plates.

The two recesses are preferably both on long sides of the angle guide plate, so that the projecting teeth can be accurately inserted into the angle guide plate.

If the two recesses are at corners of the angle guide plate, the angle guide plate can be installed more easily on the rail-mounting assembly.

If the recesses each only extend partially through the angle guide plate with respect to its plate thickness, tooth-receiving pockets that are preferably open on three sides can advantageously be formed on the angle guide plate.

An overall weight reduction can be achieved by the recesses provided on the angle guide plates in order to facilitate installation on the one hand and to ensure cost-saving use of materials on the other hand.

Advantageously, both the intermediate layer element and the hard trapezoidal intermediate layer element may here ideally be positively operatively connected with the angle guide plate.

This alone may advantageously further develop a prototypical rail-mounting assembly such that the features related to the angle guide plate are already advantageous even without the other features of the invention.

In summary, it can be stated that the essential aspect of the of the invention can be seen in that the intermediate construction between the rail and the fixed substrate of the present rail-mounting assembly comprises only the intermediate layer element described herein, and in the case of a fixed substrate with monocast or bicast sleepers or concrete supporting plates, no hard trapezoidal intermediate element according to the further aspect of the invention described herein is absolutely necessary.

However, in the case of a fixed substrate for polyvalent uses, the use of an inventive trapezoidal intermediate layer element according to this further aspect is advantageous.

Finally, it should be noted that monocast and bicast sleepers for standard uses and polyvalent uses may find application on ballasted tracks with or without the trapezoidal intermediate layer element according to the invention. This also opens the application of the invention for use in tracks for high speeds based on ballasted tracks.

By means of the present rail-mounting assembly with respect to all three aspects described herein, the necessity to provide the usual steel plates and additional highly elastic intermediate plates is eliminated, and prototypical rail-mounting assemblies can be substantially structurally simplified. The invention can thus be used for any type of fixed substrate, here in particular but also not exclusively for polyvalent systems, as described herein.

It is understood that the features of the solutions described above or in the claims can also optionally be combined in order to implement the advantages in a correspondingly cumulative manner.

BRIEF DESCRIPTION OF THE DRAWING

Further features, effects and advantages of the present invention will be described in more detail with reference to the attached drawings, in which exemplary components of an inventive rail-mounting assembly are represented and described.

Components in the individual figures that at least substantially correspond with respect to their function may hereby be identified by the same reference characters, and the components need not be numbered and described in all figures.

SPECIFIC DESCRIPTION OF THE INVENTION

Figure 1A:
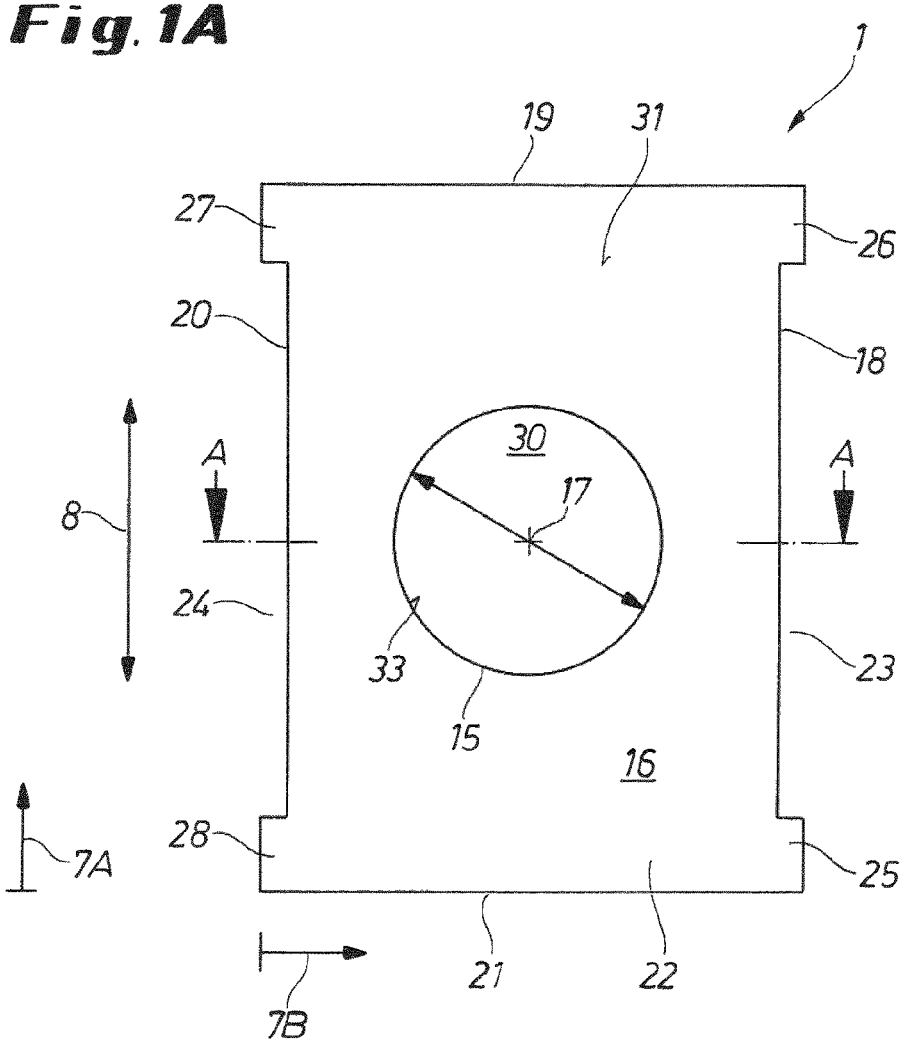
FIG. 1A is a schematic top view of a elastic intermediate layer element of a rail-mounting assembly having an elasticity distribution that varies across the cross-section.
Figure 1B:
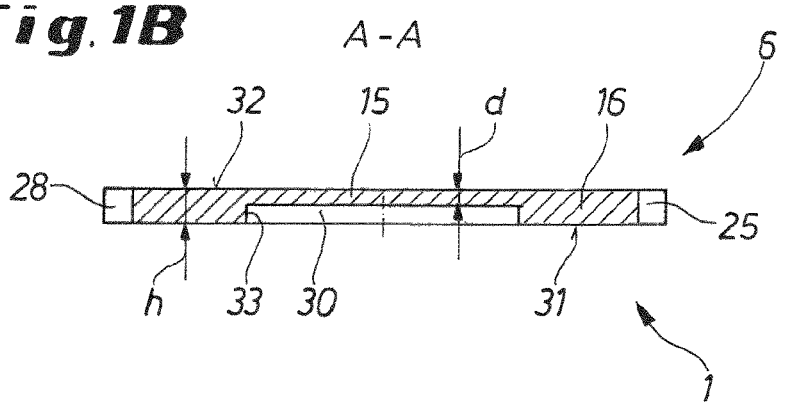
FIG. 1B is a schematic cross section through the intermediate layer element from FIG. 1A along section line A-A.

The first possible single intermediate layer element 1 shown in FIGS. 1A to 1D may be the single elastic intermediate element 1 of an intermediate construction 2 of an exemplary rail-mounting assembly S (see FIG. 6) for fastening a rail 3 to a concrete sleeper 4 of a fixed substrate 5 of an unillustrated track bed in which the intermediate layer element 1, viewed across its cross-section 6 (see also FIG. 1B), has a variable elasticity distribution both in the longitudinal direction 7A of its longitudinal extension 8 and in the transverse direction 7B transverse to its longitudinal extension 8 (transverse extension).

Figure 6:
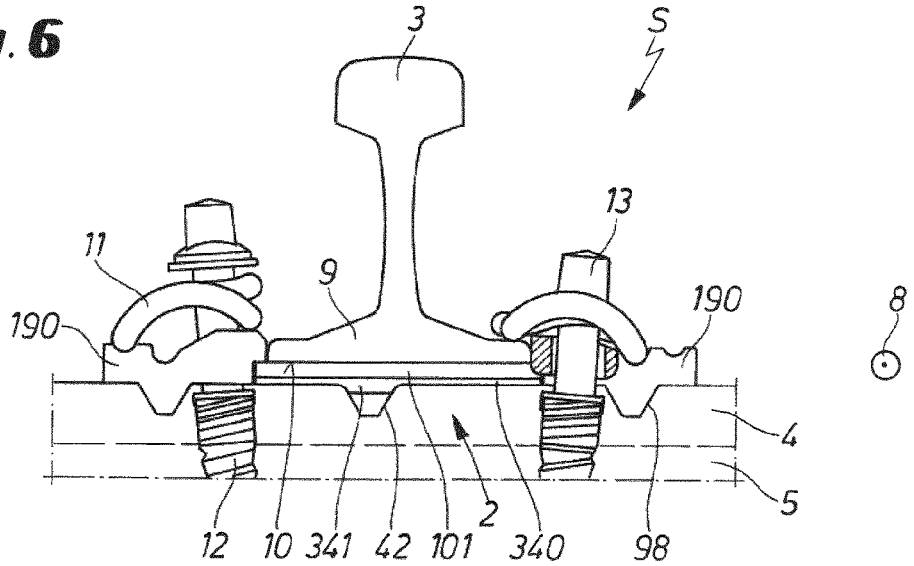
FIG. 6 is a schematic top view of an example of a rail-mounting assembly.

This intermediate layer element 1 sits directly under a foot 9 of the rail 3 and thus to a lower face 10 of the rail 3 (see also FIG. 6).

The elastic intermediate layer element 1 has two zones of different elasticity, specifically a circular inner region 15 and a less elastically deformable outer region 16, and in corresponding embodiments of the intermediate layer element 1, this inner region 15 may alternatively also be elliptical or oval.

The elastic circular inner region 15 extends concentrically about a center point 17 of the intermediate layer element 1 and in the intermediate layer element 1 it is fully offset from the peripheral sides or edges 18, 19, 20, and 21 of the intermediate layer element 1.

Figure 1C:
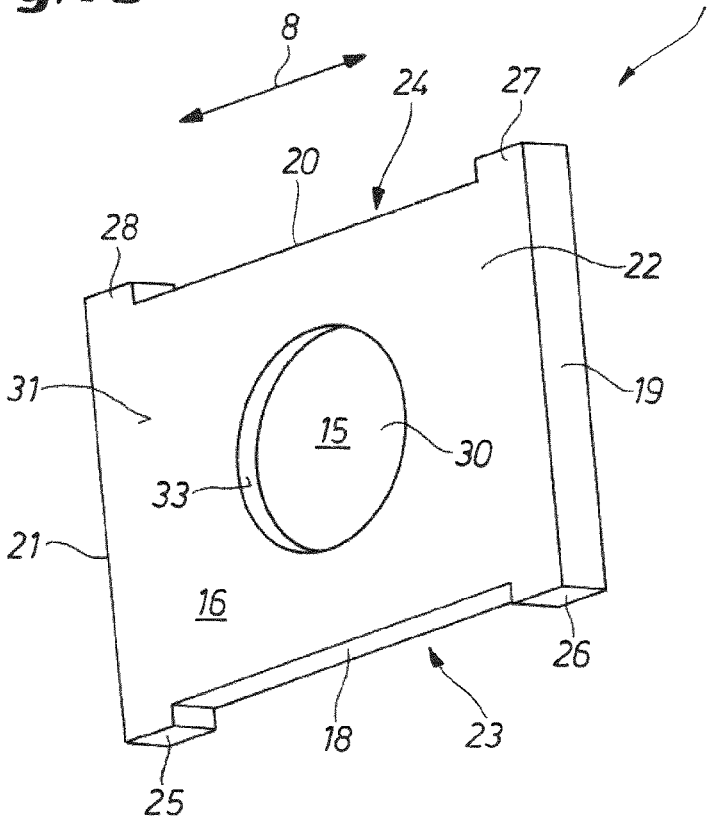
FIG. 1C is a schematic perspective top view of the single elastic intermediate element of FIGS. 1A and 1B.
Figure 1D:
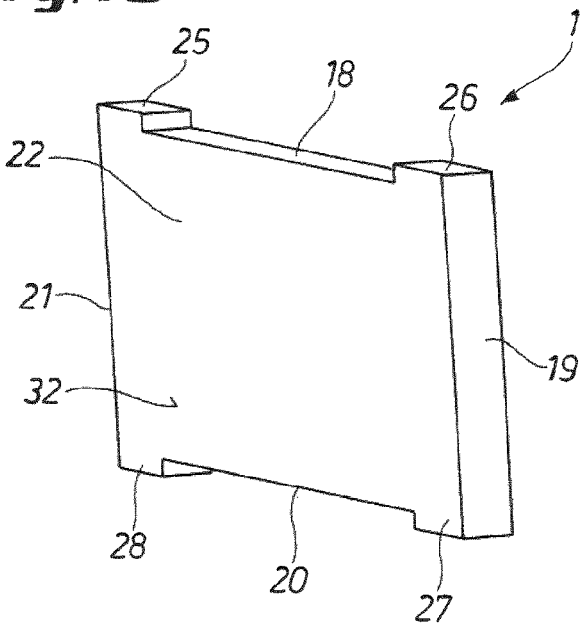
FIG. 1D is a schematic perspective bottom view of the intermediate layer element of FIGS. 1A to 1C.

As can be seen particularly well in FIGS. 1A and 1C, the less elastically deformable outer region 16 completely surrounds the elastic circular inner region 15.

The elastic circular inner region 15 has a diameter D of 80 mm.

Here, the elastic circular inner region 15 has a minimum spacing from all edges 18 to 21 of 20 mm, in order to ensure a sufficient overall stability of the intermediate layer element 1 for the long term.

The intermediate layer element 1 is thinner in the elastic circular inner region 15 than in the less elastically deformable outer region 16, and at least in the illustrated embodiment the elasticity distribution that varies across the cross-section 6 can be easily structurally created and adjusted.

In the elastic circular inner region 15, the intermediate layer element 1 only has a thickness d of 5.5 mm, whereas in the less elastically deformable outer region 16, it has a thickness or height h of 10 mm.

Furthermore, the intermediate layer element 1 in this embodiment has a body 22 made of ethylene propylene diene rubber, EPDM for short.

The intermediate layer element 1 has a static spring rate of 35 kn/mm, a dynamic spring rate of <45 kN/mm and thus a stiffening factor <1.3 with respect to the relationship between dynamic spring rate and static spring rate.

Further, the intermediate layer element 1 has elongated notches 23 or 24 on its long side edges 18 and 20 whose length (not separately numbered) extends in the direction 7A of the longitudinal extension 8 of the intermediate layer element 1.

Due to these elongated notches 23 and 24, the intermediate layer element 1 has two teeth 25 and 26 or 27 and 28 projecting from each of its long side edges 18 and 20, and the intermediate layer element 1 can be positively interlocked particularly well on its long side edges 18 and 20 with a further component of the rail-mounting assembly S, such as an angle guide plate 90 (see in particular FIGS. 5A to 5D) of the rail-mounting assembly S, for example to improve a flow of forces within the rail-mounting assembly S. The projecting teeth 25 and 26 or 27 and 28 project here past the respective notches 23 and 24.

The intermediate layer element 1 with its elasticity distribution that varies across the cross-section 6 is simply constructed in that the elastic circular inner region 15 is created by a correspondingly large circular recess 30 formed centrally in the intermediate layer element 1. This circular recess 30 is centered on the center point 17 of the intermediate layer element 1.

While the intermediate layer element 1 has this circular recess 30 on its upper face 31, its lower face 32 is completely planar.

Since the intermediate layer element 1 is only about half as thin in the elastic circular inner region 15 due to the circular recess 30 than in the less elastically deformable outer region 16, the variable elasticity distribution of the intermediate layer element 1 in the direction 7 of the longitudinal extension 8 does not change continuously, but rather it changes abruptly at the edge 33 of the circular recess 30.

Through the circular recess 30, not only the elastic circular inner region 15 is created, but also the less elastically deformable outer region 16.

In addition to the intermediate layer element 1, the first possible hard trapezoidal intermediate layer element 40 shown in FIGS. 2A to 2D may be the single further component of the intermediate construction 2 of the rail-mounting assembly S shown by way of example in FIG. 6 for fastening the rail 3 to the concrete sleeper 4 of the fixed substrate 5.

The hard trapezoidal intermediate layer element 40 is characterized in particular by a part 41 of trapezoidal section that is formed complementarily to a groove 42 of trapezoidal section in the concrete sleeper 4 (see for example FIG. 6) and that can be inserted into this trapezoidal groove 42. As a result, the hard trapezoidal intermediate layer element 40 can conduct or transfer forces acting on the rail 4 directly into the fixed substrate 5 or into the concrete sleeper 4 by the intermediate construction 2.

The hard trapezoidal intermediate layer element 40 is between the intermediate layer element 1 and the concrete sleeper 4 of the fixed substrate 5 under the rail 4 (see for example FIG. 6) in such a way that in particular the trapezoidal part 41 can be fitted into the trapezoidal groove 42 under the rail 4. Hence the trapezoidal part 41 is below the rail 4.

The hard trapezoidal intermediate layer element 40 is flat except for the trapezoidal part 41, and has elongated notches 45 and 46 on its two long side edges 43 and 44, and these notches 45 and 46 extend in the direction 47 of the longitudinal extension 48 of the hard trapezoidal intermediate layer element 40.

The hard trapezoidal intermediate layer element 40 has two further projecting teeth 49 and 50 or 51 and 52 on each of its long side edges 43 and 44, and the hard trapezoidal intermediate layer element 40 can also be positively interlocked particularly closely on its long side edges 43 and 44 with a further component of the rail-mounting assembly S, such as an angle guide plate 90 (see in particular FIGS. 5A to 5D) of the rail-mounting assembly S, for example to improve force distribution in the rail-mounting assembly S. The teeth 49 and 50 or 51 and 52 project here past the respective notches 45 or 46.

Figure 2A:
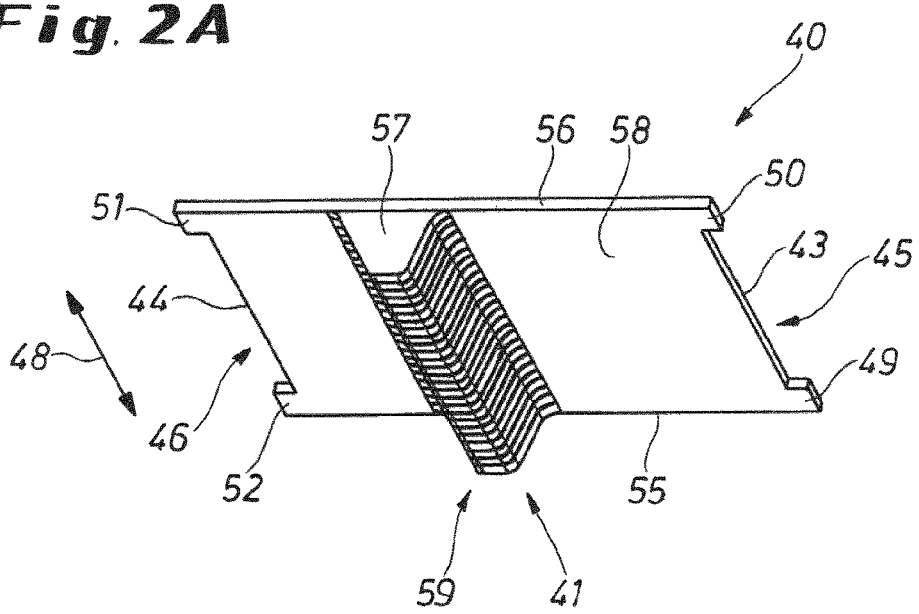
FIG. 2A is a schematic perspective top view of a hard trapezoidal intermediate layer element of a rail-mounting assembly having a trapezoidal part.
Figure 2B:
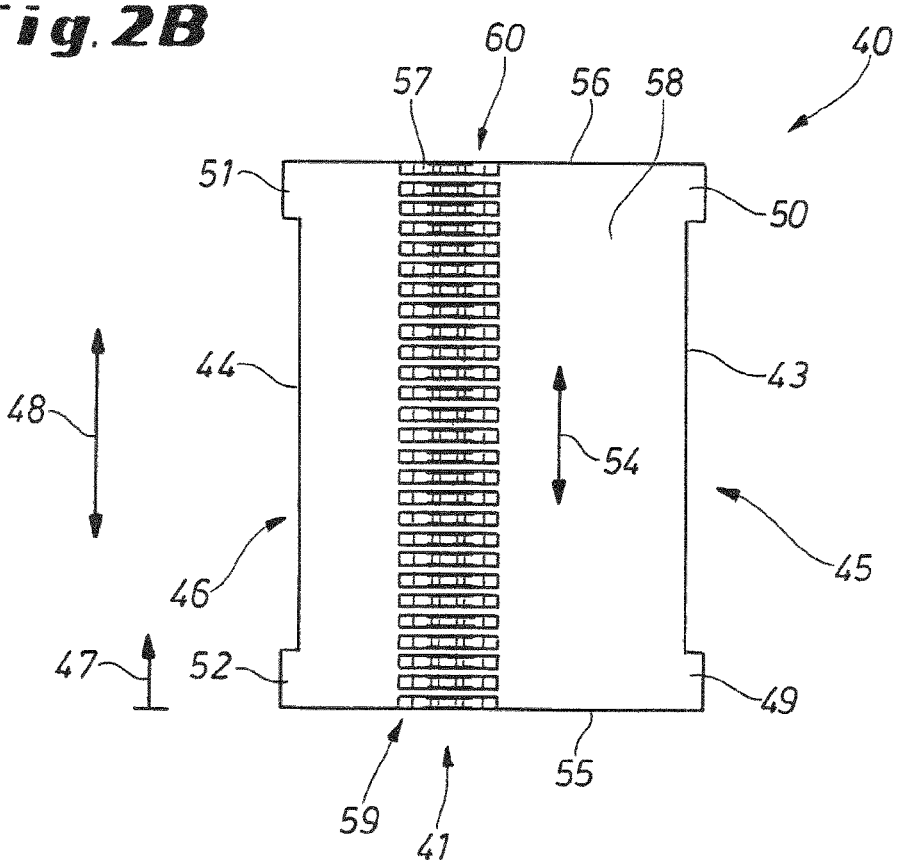
FIG. 2B is a schematic top view of the hard trapezoidal intermediate layer element of FIG. 2A.
Figure 2C:
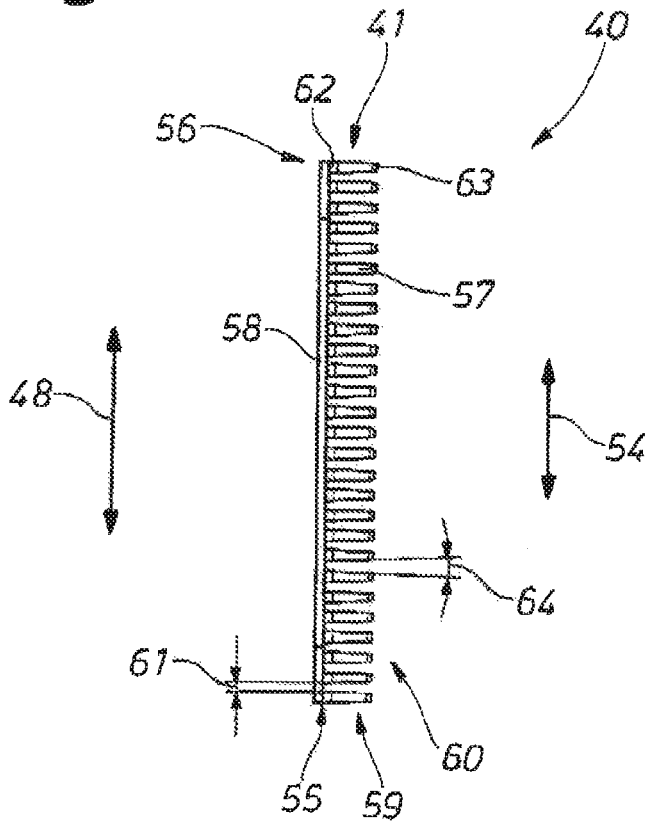
FIG. 2C is a schematic longitudinal side view of the hard trapezoidal intermediate layer element of FIGS. 2A and 2B.
Figure 2D:
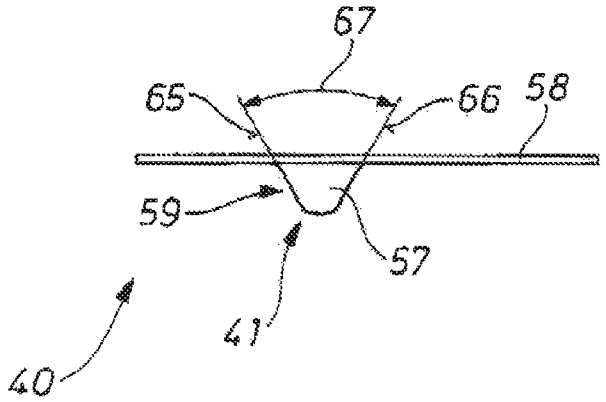
FIG. 2D is a schematic transverse view of the hard trapezoidal intermediate layer element of FIGS. 2A to 2C.

The trapezoidal part 41 extends in its longitudinal extension direction 54 from a first short side edge 55 to a second short side edge 56 of the hard trapezoidal intermediate layer element 40 and thus also in the direction 47 of the longitudinal extension 48 of the hard trapezoidal intermediate layer element 40 such that the trapezoidal part 41 is set off-center on the hard trapezoidal intermediate layer element, as can be seen particularly well in FIG. 2B.

In this embodiment, the trapezoidal part 41 consists of a plurality of cross ribs 57 (only numbered by way of example) extending transversely of the trapezoidal part longitudinal extension 54, which cross ribs 57 form a trapezoidal passage 59 on of the roughly 3 mm thick flat base body 58 of the trapezoidal part 41 the hard trapezoidal intermediate layer element 40.

The cross ribs 57 extend in a row 60 at a spacing 61 from one another of 3 mm. Here, the cross ribs 57 have legs 62 approximately 5 mm thick that extend from the base body 58 of the hard trapezoidal intermediate layer element 40.

The cross ribs 57 project from approximately 5 mm thick inner ends 62 a total of approximately 18 mm above the flat base body 58, and have a thickness of 3 mm at their respective outer ends 63. Thus narrowly tapering narrowly adjacent cross ribs 57 enclose an angle 64 of 6° with one another.

The cross ribs 57 converge to their outer ends 63 spaced approximately 10 mm apart, and their respective two legs 65 and 66 enclose a flank angle 67 with one another of 60°.

Figure 3A:
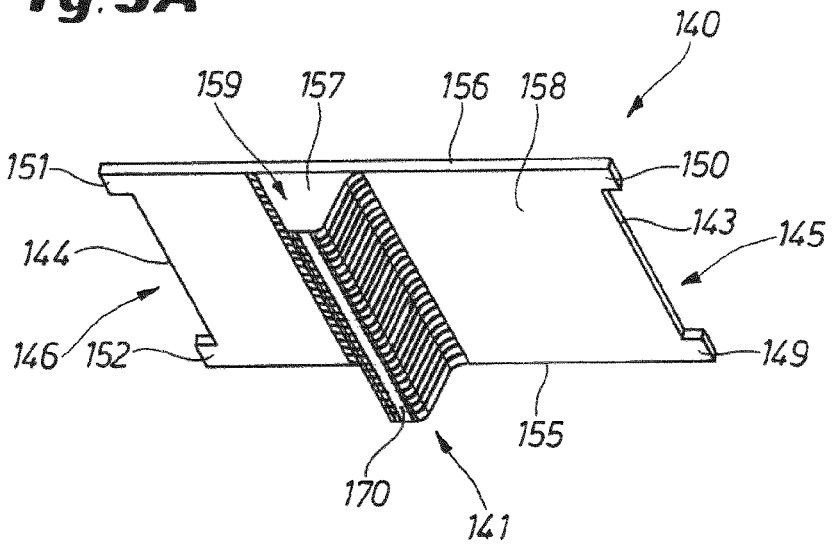
FIG. 3A is a schematic perspective top view of an alternative hard trapezoidal intermediate layer element of a rail-mounting assembly having a trapezoidal part.
Figure 3B:
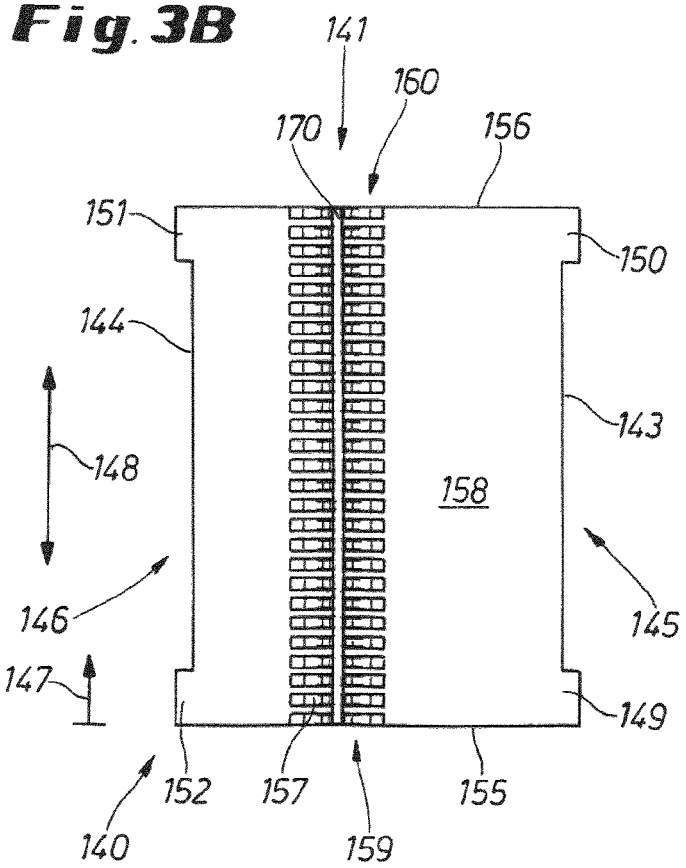
FIG. 3B is a schematic top view of the alternative hard trapezoidal intermediate layer element of FIG. 3A.
Figure 3C:
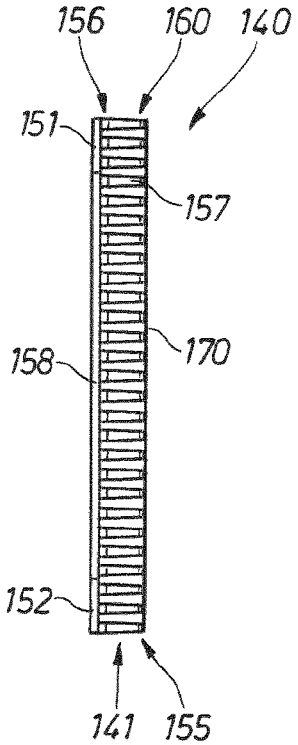
FIG. 3C is a schematic longitudinal side view of the alternative hard trapezoidal intermediate layer element of FIGS. 3A and 3B.
Figure 4A:
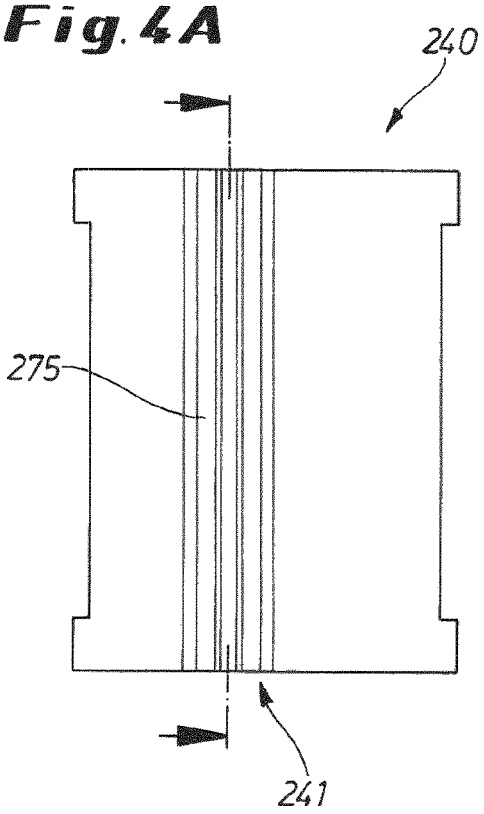
FIG. 4A is a schematic perspective top view of a further alternative hard trapezoidal intermediate layer element of a rail-mounting assembly having a tubular part of trapezoidal section.
Figure 4B:
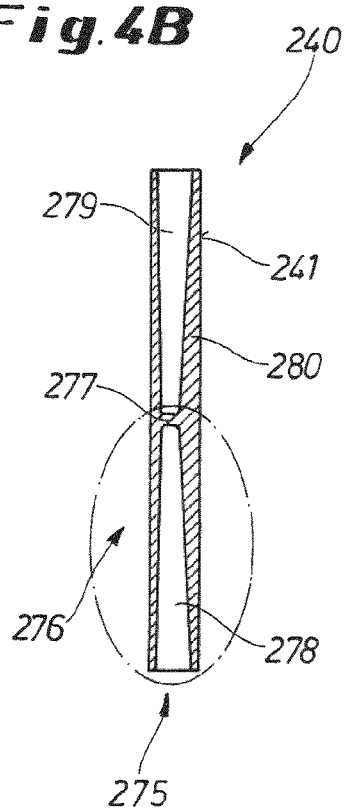
FIG. 4B is a schematic longitudinal view of the further alternative trapezoidal intermediate layer element of FIG. 4A.
Figure 4C:
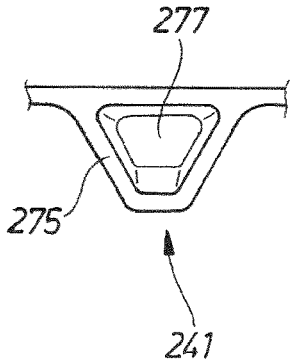
FIG. 4C is a schematic transversely sectioned detail view of the tubular part of trapezoidal section of the further alternative hard trapezoidal intermediate layer element of FIGS. 4A and 4B.
Figure 4D:
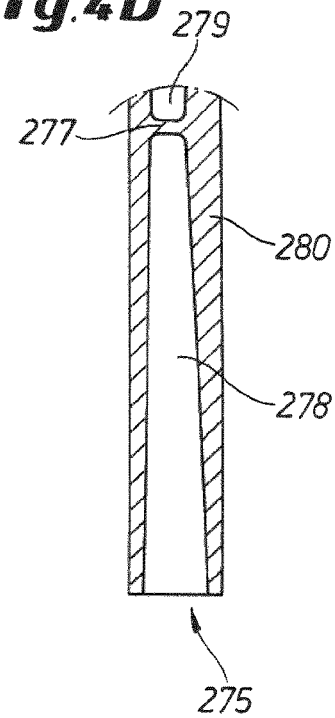
FIG. 4D is a schematic longitudinally sectioned detail view of the tubular part of trapezoidal section of the further alternative hard trapezoidal intermediate layer element of FIGS. 4A to 4C.
Figure 5A:
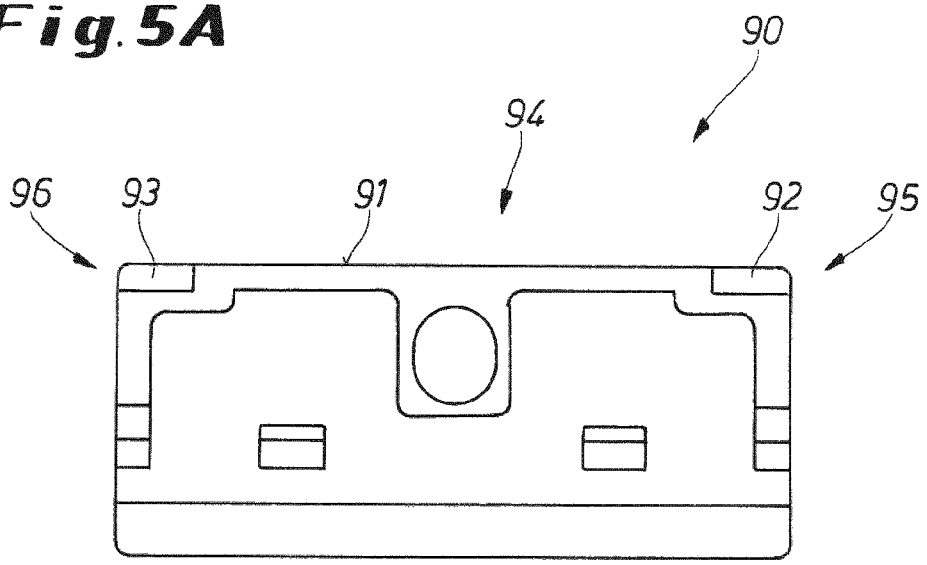
FIG. 5A is a schematic bottom view of an angle guide plate of a rail-mounting assembly having two recesses for receiving projecting teeth on at least two plate ends.
Figure 5B:
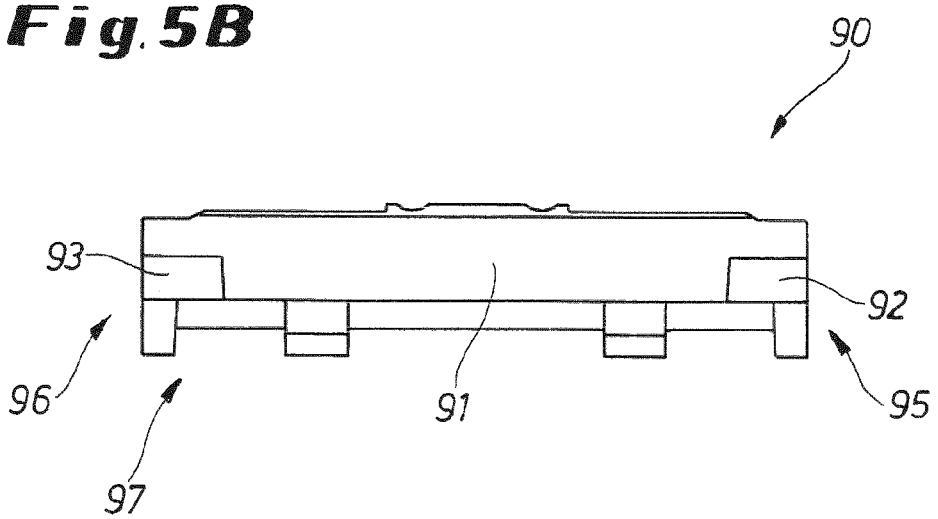
FIG. 5B is a schematic longitudinal view of the angle guide plate of FIG. 5A.
Figure 5C:
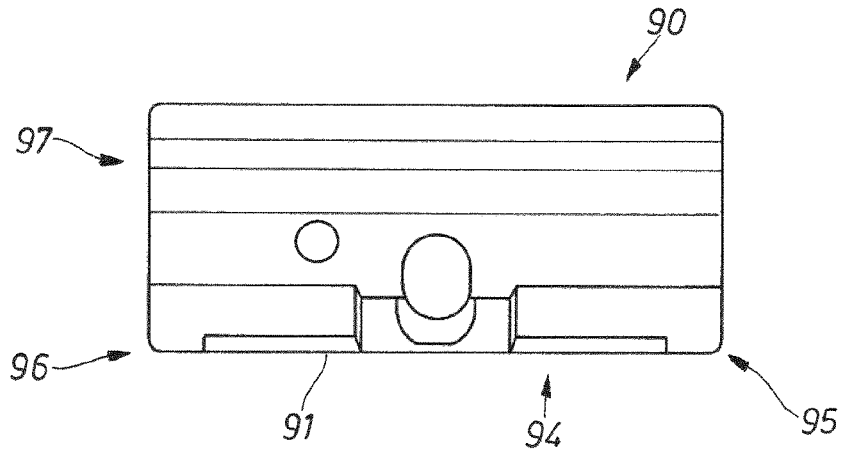
FIG. 5C is a schematic top view of the angle guide plate of FIGS. 5A and 5B.
Figure 5D:
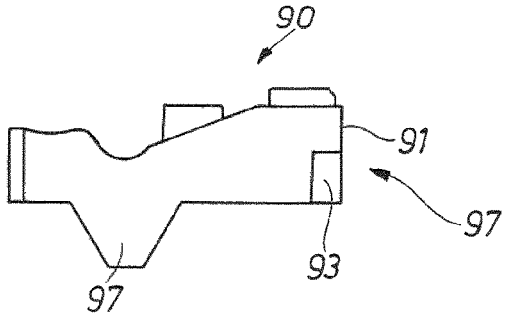
FIG. 5D is a schematic transverse view of the angle guide plate of FIGS. 5A to 5C.

In addition to the intermediate layer element 1, the alternative possible hard trapezoidal intermediate layer element 140 shown in FIGS. 3A to 3C may likewise be the single further component of the intermediate construction 2 of the rail-mounting assembly S shown by way of example in FIG. 6 for fastening the rail 3 to the concrete sleeper 4 of the fixed substrate 5.

The alternative hard trapezoidal intermediate layer element 140 has a trapezoidal part 141 that is complementary to a trapezoidal groove 42 present in the concrete sleeper 4 (see for example FIG. 6), so that, also the alternative hard trapezoidal intermediate layer element 140 can conduct or transverse forces acting on the rail 4 directly into the fixed substrate 5 or into the respective concrete sleeper 4 by means of the intermediate construction 2. The hard trapezoidal intermediate layer element 140 is between the intermediate layer element 1 and the concrete sleeper 4 of the fixed substrate 5 under the rail 4 (see for example FIG. 6) in such a way that in particular the trapezoidal part 141 can be placed in a trapezoidal groove 42 located under the rail 4.

With its flat base body 158, the alternative hard trapezoidal intermediate layer element 140 is flat except for the trapezoidal part 141, and has an elongated notch 145 or 146 on each of its two long side edges 143 and 144 that extend in the direction 147 of the longitudinal extension 148 of the hard trapezoidal intermediate layer element 140.

On the two long side edges 143 and 144, the alternative hard trapezoidal intermediate layer element 140 also has two projecting teeth 149 and 150 or 151 and 152. Here, too, the projecting teeth 149 and 150 or 151 and 152 project past the respective notch 145 or 146.

With its trapezoidal longitudinal extension 154, the trapezoidal part 141 extends from a first short side edge 155 to a second short side edge 156 of the alternative hard trapezoidal intermediate layer element 140 and thus also in the direction 147 of the longitudinal extension 148 of the alternative hard trapezoidal intermediate layer element 140.

In this alternative embodiment, the trapezoidal part 141 also consists of a plurality of cross ribs 157 (only numbered by way of example) extending transversely with respect to the trapezoidal part longitudinal extension 154, which cross ribs 57 form a trapezoidal body 59 of the trapezoidal part 159 on the flat base body 58 of the alternative hard trapezoidal intermediate layer element 140.

The cross ribs 157 are next to one another in a row 160 and spaced apart from one another, and the individual cross-rib members 157 are also interconnected by a central web part 170. As a result, the stability of the trapezoidal part 141 is significantly increased.

Except for the central web part 170, the alternative hard trapezoidal intermediate layer element 140 of FIGS. 3A to 3C is identical to the hard trapezoidal intermediate layer element 40 shown in FIGS. 2A to 2D. In this respect, reference is also made to the description thereof.

In addition to the intermediate layer element 1, the further possible hard trapezoidal intermediate layer element 240 shown in FIGS. 4A to 4D may likewise be the single further component of the intermediate construction 2 of the rail-mounting assembly S shown by way of example in FIG. 6 for fastening the rail 3 to the concrete sleeper 4 of the fixed substrate 5.

Except for its trapezoidal part 241, the further hard trapezoidal intermediate layer element 240 is substantially identical to the previously described hard trapezoidal intermediate layer elements 40 (FIGS. 2A to 2D) and 140 (FIGS. 3A to 3C). In this respect, only the differently designed trapezoidal part 241 will be discussed, and reference is made to the above description with respect to the remaining structure of the further hard trapezoidal intermediate layer element 240, in order to avoid repetitions.

The trapezoidal part 241 of the further hard trapezoidal intermediate layer element 240 is characterized by a tubular body 275 that has a two-part cavity 276 subdivided by a stabilizing transverse inner web 277. Because of the tubular body 275, the trapezoidal part 241 is constructed with less material and the further trapezoidal intermediate layer element 240 is correspondingly light. Here, the two hollow chambers 278 and 279 of the two-part cavity 276 are of frustoconical shape and formed by reinforced wall portions 280 (only numbered by way of example), so that the trapezoidal part 241 is very stable in spite of the tubular body 275.

FIGS. 5A to 5D show a first angled guide plate 90 of the rail-mounting assembly S (see FIG. 6) that fastens a rail 3 to a concrete sleeper 4 of the fixed substrate 5 of a track bed (not shown) and that has at one end 91 two recesses 92 and 93, in which the described projecting teeth 25, 26 or 27, 28 and 49, 50 or 51, 52 or 149, 150 or 151, 152 and the corresponding components of the intermediate construction 2 couple with the angle guide plate 90 positively and in particular closely with one another.

Here, the two recesses 92 and 93 are on a long side 94 of the angle guide plate 90 and also in the corners 95 and 96 of the long side 94, so that the projecting teeth 25, 26 or 27, 28 and 49, 50 or 51, 52 or 149 150 or 151, 152 formed complementarily thereto can engage accurately in the respective recesses 92 and 93.

The angle guide plate 90 has a trapezoidal wedge element 97, by means of which it can engage in a further trapezoidal groove 98 (see FIG. 6) of the fixed substrate 5.

The rail-mounting assembly S shown by way of example in FIG. 6 has the present advantageous intermediate construction 2, composed only of an inventive single elastic intermediate element 101 of a hard trapezoidal intermediate layer element 340 inventively comprising a trapezoidal part 341 (see FIGS. 1 to 4).

The hard trapezoidal intermediate layer element 340 is fixed in the trapezoidal groove 42 of the concrete sleeper 4 by means of its trapezoidal part 341, as has previously been described in detail.

This intermediate layer element 101 and this hard trapezoidal intermediate layer element 340 are also positively interlinked with the angle guide plates 190 in the manner described above (see FIG. 5).

Both the rail foot 9 and the respective angle guide plates 190 are hereby clamped against the concrete sleeper 4 by means of a conventional tension clip 11 (only numbered by way of example)

For this purpose, the tension clamp 11 (only numbered by way of example) is held down by a screw 13 (only numbered by way of example) that is screwed into an anchor fitting 12 (only numbered by way of example), introduced in the concrete sleeper 4, with inner and outer threads in a known manner.

At this point, it should be explicitly pointed out that the features of the solution described above or in the claims and/or in the figures may optionally also be combined in order to make use of or achieve the explained features, effects and advantages in a correspondingly cumulative manner.

It is understood that the illustrated embodiments detailed above are merely first embodiments. In this respect, the embodiment of the invention is not limited to these embodiments.

The invention claimed is:

1. A rail-mounting assembly for fastening a rail to a fixed substrate including polyvalent sleepers, the assembly being between the rail and the fixed substrate operatively connected to the fixed substrate in an elastic manner, and comprising a single elastic intermediate layer element having a variable elasticity distribution across its cross-section in the direction of its longitudinal extension and/or in the direction transverse to its longitudinal extension; and a hard intermediate element having a trapezoidal part and lying between the elastic intermediate layer element and the fixed substrate.

2. The rail-mounting assembly according to claim 1, wherein the elastic intermediate layer element bears directly against a lower face of the rail.

3. The rail-mounting assembly according to claim 1, wherein the elastic intermediate layer element has an elastically deformable inner region that is completely spaced from edges of the elastic intermediate layer element, and the spacing from the edges is smaller than 30 mm.

4. The rail-mounting assembly according to claim 3, wherein the elastic intermediate layer element has an outer region that completely surrounds the elastically deformable inner region and that is less elastic than the elastically deformable inner region.

5. The rail-mounting assembly according to claim 1, wherein the elastic intermediate layer element has an elastically deformable inner region that is concentric to a center point of the elastic intermediate layer element.

6. The rail-mounting assembly according to claim 1, wherein the elastic intermediate layer element has a circular, elliptical or oval elastic inner region that is more elastically deformable than a less elastically deformable outer region surrounding the circular, elliptical or oval elastic inner region.

7. The rail-mounting assembly according to claim 6, wherein the elastically deformable inner region is thinner than an adjacent less elastically deformable outer region of the elastic intermediate layer element.

8. The rail-mounting assembly according to claim 1, wherein the elastic intermediate layer element is made from microcellular rubber or polyurethane.

9. The rail-mounting assembly according to claim 1, wherein the elastic intermediate layer element has an elongated notch on each of two of its edges.

10. The rail-mounting assembly according to claim 9, wherein the elongated notch extends in a direction of a long side edge of the elastic intermediate layer element.

11. The rail-mounting assembly according to claim 1, wherein the elastic intermediate layer element has two projecting teeth on each of two of its edges.

12. The rail-mounting assembly according to claim 1, wherein the hard intermediate layer element is fixed to the fixed substrate by lateral angle guide plates.

13. The rail-mounting assembly according to claim 1, wherein the trapezoidal part of the hard intermediate layer element extends toward the fixed substrate.

14. The rail-mounting assembly according to claim 1, wherein the trapezoidal part is below the rail.

15. The rail-mounting assembly according to claim 1, wherein the trapezoidal part is tubular.

16. A rail-mounting assembly for fastening a rail to a fixed substrate including polyvalent sleepers, the assembly being between the rail and the fixed substrate operatively connected to the fixed substrate in an elastic manner, and comprising a single elastic intermediate layer element having a variable elasticity distribution across its cross-section in the direction of its longitudinal extension and/or in the direction transverse to its longitudinal extension; and a hard intermediate element having a trapezoidal part and lying between the elastic intermediate layer element and the fixed substrate, the trapezoidal part is formed by a plurality of cross ribs reinforced by a central web part.

17. A rail-mounting assembly for fastening a rail to a fixed substrate including polyvalent sleepers, the assembly being between the rail and the fixed substrate operatively connected to the fixed substrate in an elastic manner, and comprising:

a single elastic intermediate layer element having a variable elasticity distribution across its cross-section in the direction of its longitudinal extension and/or in the direction transverse to its longitudinal extension; and a hard intermediate element having a tubular trapezoidal part and lying between the elastic intermediate layer element and the fixed substrate, the tubular trapezoidal part a two-part cavity that is spatially divided by a transverse inner web.

18. A rail-mounting assembly for fastening a rail to a fixed substrate including polyvalent sleepers, the assembly being between the rail and the fixed substrate operatively connected to the fixed substrate in an elastic manner, and comprising:

a single elastic intermediate layer element having a variable elasticity distribution across its cross-section in the direction of its longitudinal extension and/or in the direction transverse to its longitudinal extension; and a hard intermediate element having a trapezoidal part, lying between the elastic intermediate layer element and the fixed substrate, and having an elongated notch on each of two of its edges.

19. The rail-mounting assembly according to claim 18, wherein each elongated notch extends in the direction of longitudinal extension of the hard intermediate layer element.

20. A rail-mounting assembly for fastening a rail to a fixed substrate including polyvalent sleepers, the assembly being between the rail and the fixed substrate operatively connected to the fixed substrate in an elastic manner, and comprising a single elastic intermediate layer element having a variable elasticity distribution across its cross-section in the direction of its longitudinal extension and/or in the direction transverse to its longitudinal extension; and a hard intermediate element having a trapezoidal part, lying between the elastic intermediate layer element and the fixed substrate, and having two projecting teeth on each of two of its edges.

21. The rail-mounting assembly according to claim 20, further comprising:

an angle guide plate that has two recesses on an end of the plate for receiving the teeth.

22. The rail-mounting assembly according to claim 21, wherein the two recesses are both on a long side of the angle guide plate.

23. The rail-mounting assembly according to claim 21, wherein the two recesses are both at corners of the angle guide plate.

24. The rail-mounting assembly according to claim 21, wherein the recesses only extend partially through a thickness of the angle guide plate.

* * * * *